US010717567B2

(12) United States Patent
Sakamoto et al.

(10) Patent No.: US 10,717,567 B2
(45) Date of Patent: Jul. 21, 2020

(54) DISCHARGE CONTAINER

(71) Applicant: YOSHINO KOGYOSHO CO., LTD., Tokyo (JP)

(72) Inventors: Satoshi Sakamoto, Tokyo (JP); Katsuhito Kuwahara, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/305,379

(22) PCT Filed: May 9, 2017

(86) PCT No.: PCT/JP2017/017584
§ 371 (c)(1),
(2) Date: Nov. 28, 2018

(87) PCT Pub. No.: WO2018/003300
PCT Pub. Date: Jan. 4, 2018

(65) Prior Publication Data

US 2019/0329942 A1 Oct. 31, 2019

(30) Foreign Application Priority Data

Jun. 30, 2016 (JP) ..... 2016-131071

(51) Int. Cl.
*B65D 47/20* (2006.01)
*B65D 1/02* (2006.01)
(Continued)

(52) U.S. Cl.
CPC ..... *B65D 47/2056* (2013.01); *B65D 1/0215* (2013.01); *B65D 47/0838* (2013.01); *B65D 47/32* (2013.01); *B65D 2205/02* (2013.01)

(58) Field of Classification Search
CPC ..... B65D 47/2056; B65D 1/0215; B65D 47/0838; B65D 47/32; B65D 2205/02
(Continued)

(56) References Cited

U.S. PATENT DOCUMENTS 5,366,115 A * 11/1994 Kersten ..... B05B 11/047 222/105
2002/0130139 A1* 9/2002 Shiraishi ..... B65D 23/02 222/105
(Continued)

FOREIGN PATENT DOCUMENTS

CN 203877153 U 10/2014
JP 2004-149185 A 5/2004
(Continued)

OTHER PUBLICATIONS

JP 2012 136275 with Machine Translation.*
(Continued)

*Primary Examiner* — Vishal Pancholi
(74) *Attorney, Agent, or Firm* — Oliff PLC

(57) ABSTRACT

A discharge container including: a container body having an outer layer body with an outside air introduction hole and an inner layer body held inside of the outer layer body and configured to be deformable to undergo volume reduction; an inner plug having a partition wall covering an opening of a mouth and a sealing tube protruded from an undersurface of the partition wall and in abutment with an inner periphery of the mouth; a discharge cap having a discharge port from which contents are discharged and attached to the mouth to surround the inner plug from outside; and a valve body disposed between the inner plug and the discharge cap and configured to open/close an outflow hole provided in the partition wall, wherein the inner plug or the discharge cap
(Continued)

has a deformation suppressing portion in abutment with an outer periphery of a upper end of the mouth.

5 Claims, 5 Drawing Sheets

(51) Int. Cl.
*B65D 47/08* (2006.01)
*B65D 47/32* (2006.01)

(58) Field of Classification Search
USPC ..... 222/481
See application file for complete search history.

(56) References Cited

U.S. PATENT DOCUMENTS

| | | | | |
|---|---|---|---|---|
| 2014/0144938 | A1* | 5/2014 | Kakuta | B65D 35/14 222/105 |
| 2014/0263443 | A1* | 9/2014 | Furusawa | B65D 83/0055 222/105 |
| 2015/0001260 | A1* | 1/2015 | Hoshino | B65D 47/40 222/481 |
| 2016/0145015 | A1 | 5/2016 | Hoshino et al. | |

FOREIGN PATENT DOCUMENTS

| | | | |
|---|---|---|---|
| JP | 2012-136275 | A | 7/2012 |
| JP | 2014-028642 | A | 2/2014 |
| JP | 2015-227175 | A | 12/2015 |
| JP | 2016-050003 | A | 4/2016 |
| JP | 2016-055893 | A | 4/2016 |
| JP | 2016-068998 | A | 5/2016 |
| JP | 2017-065773 | A | 4/2017 |

OTHER PUBLICATIONS

Jan. 1, 2019 International Preliminary Report on Patentability issued in International Patent Application No. PCT/JP2017/017584.
Aug. 1, 2017 International Search Report issued in International Patent Application No. PCT/JP2017/017584.
Aug. 21, 2019 Office Action issued in Chinese Patent Application No. 201780034896.7.
Nov. 19, 2019 Office Action issued in Japanese Patent Application No. 2016-131071.
Feb. 6, 2020 Office Action issued in Chinese Patent Application No. 201780034896.7.
Feb. 17, 2020 Extended European Search Report issued in European Patent Application No. 17819667.1.

* cited by examiner

DISCHARGE CONTAINER

TECHNICAL FIELD

The present disclosure relates to a discharge container that includes: a container body having an outer layer body provided with an outside air introduction hole and an inner layer body held on the inside of the outer layer body and configured to be deformable to undergo volume reduction; an inner plug disposed in a mouth of the container body; and a discharge cap attached to the mouth so as to surround the inner plug.

BACKGROUND

Conventionally, as a discharge container that contains cosmetics such as lotions, shampoos, rinses or liquid soaps, food seasonings, chemicals or the like as contents, a discharge container has been known. The discharge container includes: a container body of a double container structure formed of an outer layer body and an inner layer body; an inner plug having a partition wall that covers an opening of a mouth of the container body; and a discharge cap having a discharge port that discharges contents and attached to the mouth so as to surround the inner plug (see PTL 1). In this discharge container, an outside air introduction hole passing through the outer layer body is formed in the mouth of the container body, and the outside air is taken through the outside air introduction hole into an inner space between the outer layer body and the inner layer body. Further, a valve body that opens and closes an outflow hole provided in the partition wall of the inner plug is disposed on the inside of the discharge cap. The valve body allows the contents to move from the containing space to the discharge port and prevents the contents and the outside air from flowing into the containing space from the discharge port.

In the discharge container configured in the above described manner, when a barrel of the container body is pressed (squeezed) to discharge the contents from the discharge port and then the pressing of the barrel is cancelled, the outflow hole is blocked by the valve body such that the contents and the outside air are prevented from flowing from the discharge port into the container body and the outside air is introduced from the mouth of the air intake hole provided in the discharge cap into the inner space between the outer layer body and the inner layer body through the outside air introduction hole. Thus the outer layer body can be restored to its original shape with the inner layer body deformed to undergo volume reduction. Therefore, the contents in the container body can be discharged without being replaced with the outside air, which makes it difficult for the contents remained in the containing space of the container body to come in contact with the air, and thus deterioration and change in quality of the contents can be suppressed.

CITATION LIST

Patent Literature

PTL 1: JP2015227175 (A)

SUMMARY

Technical Problem

In the above described discharge container, a sealing tube protruding from the undersurface of a partition wall of an inner plug is brought into abutment with an inner periphery of a mouth so as to enhance the air tightness (sealing performance) of the opening of the mouth. However, when a heat filling in which contents heated up to a predetermined temperature (e.g. 85° C. or more) is filled in the containing space of the container body for the purpose of sterilization is performed, the mouth is soften by heat and is radially and outwardly deformed, which may generate a clearance between the sealing tube and the inner periphery of the mouth, and the air tightness may deteriorate.

Thus the present disclosure is to provide a discharge container that can suppress decline in the air tightness even when heated contents are filled.

Solution to Problem

The present disclosure has been made to solve the above described problem, and the disclosed discharge container includes:

a container body having an outer layer body provided with an outside air introduction hole and an inner layer body held on the inside of the outer layer body and configured to be deformable to undergo volume reduction;

an inner plug having a partition wall covering an opening of a mouth of the container body and a sealing tube protruding from the undersurface of the partition wall and being in abutment with an inner periphery of the mouth;

a discharge cap having a discharge port that discharges contents and attached to the mouth so as to surround the inner plug from outside; and a valve body disposed between the inner plug and the discharge cap and configured to open/close an outflow hole provided in the partition wall, wherein the inner plug or the discharge cap has a deformation suppressing portion in abutment with an outer periphery of a upper end of the mouth.

Further, in the disclosed discharge container, preferably, the deformation suppressing portion is formed of a support protrusion provided at a tube wall portion of the discharge cap located radially outside of the mouth.

Further, in the disclosed discharge container, preferably, the deformation suppressing portion is formed of an outer peripheral tube protruding from the undersurface of the partition wall.

Further, in the disclosed discharge container, preferably, the deformation suppressing portion is formed of a plurality of longitudinal ribs circumferentially disposed at intervals on the discharge cap.

Further, in the disclosed discharge container, preferably, the deformation suppressing portion is formed of an annular supporting wall protruded from the undersurface of the top wall portion of the discharge cap.

Further, in the disclosed discharge container, preferably, a tilting tube tapered upward is provided on the top of the mouth, and the tilting tube is provided with the outside air introduction hole.

Advantageous Effect

According to the present disclosure, a discharge container that can suppress decline in air tightness even in the case where heated contents are filled can be provided.

DETAILED DESCRIPTION

Figure 1A:
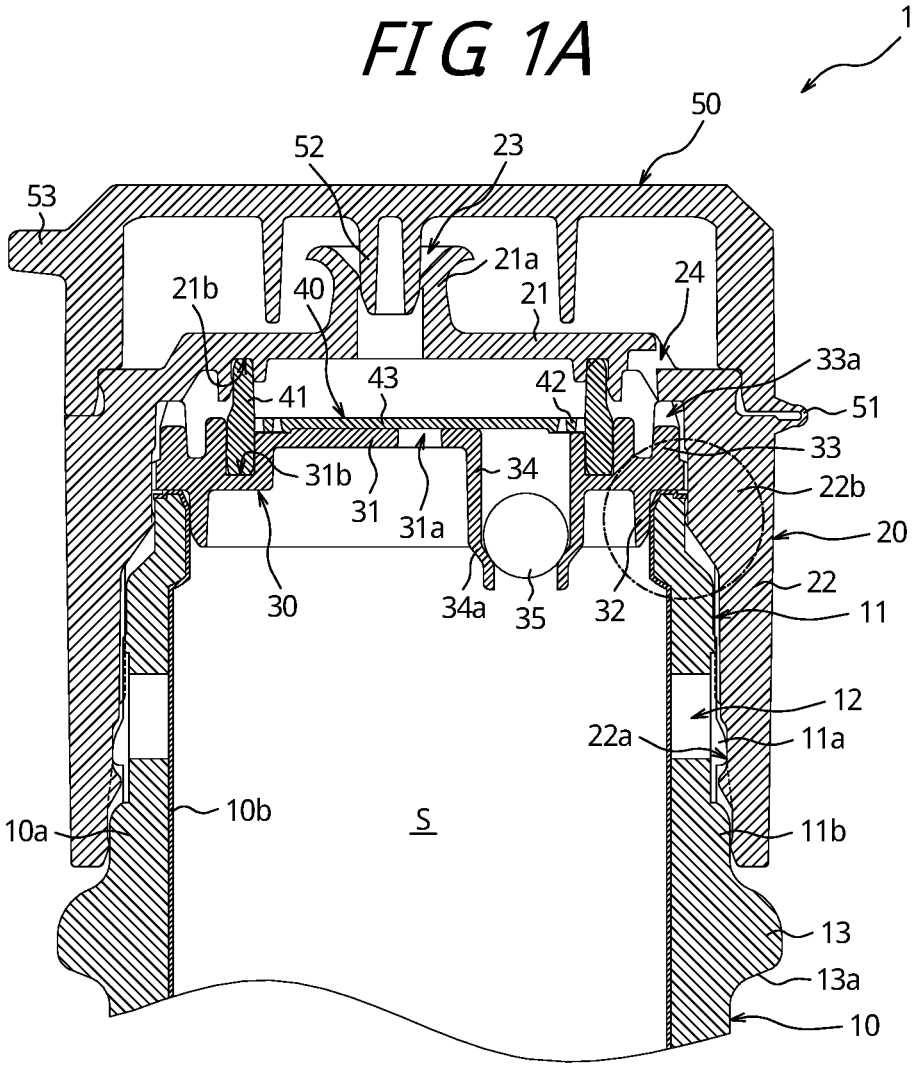
FIG. 1A is a cross-sectional diagram of a main part of a discharge container according to an embodiment of the present disclosure viewed from the side.

The present disclosure will be described in more detail below with reference to the drawings. It is to be noted that, in this specification, "above" is the side on which the discharge cap is located relative to the container body when the discharge container is placed on the horizontal surface, and "under" is the opposite side thereof.

As illustrated in FIG. 1, a discharge container 1 according to an embodiment of the present disclosure includes a container body 10, a discharge cap 20, an inner plug 30, a valve body 40 and a lid body 50. The discharge container 1 can contain a variety of contents.

Although not illustrated in detail, the container body 10 includes a cylindrical mouth 11, and is formed into a bottle shape provided with a barrel and a bottom under the mouth 11.

In the present embodiment, the container body 10 has a double container structure including an outer layer body 10*a* and an inner layer body 10*b* held on the inside of the outer layer body 10*a*. It is to be noted that, in this example, although the container body 10 is a lamination separated container (delaminated container) in which the inner layer body 10*b* is separably laminated and disposed on the inner surface of the outer layer body 10*a*, it is not limited thereto, and the container body 10 may have a double container structure in which the inner layer body 10*b* is incorporated into the outer layer body 10*a*.

The inner layer body 10*b* is formed into a thin bag shape configured to be deformable to undergo volume reduction by a synthetic resin material, for example, and is separably laminated and disposed on the inner surface of the outer layer body 10*a*. The inner layer body 10*b* extends up to the open end of the mouth 11 of the container body 10 and opens at the open end. The inside thereof is a containing space S for contents.

The outer layer body 10*a* is formed of, for example, a synthetic resin material into a bottle shape having a specific rigidity and forms an outer frame of the container body 10. The portion corresponding to the barrel of the outer layer body 10*a* can be pressed (squeezed) and restored to its original shape. Further, the portion corresponding to the mouth 11 of the outer layer body 10*a* is provided with an outside air introduction hole 12 radially passing through the outer layer body 10*a* and communicating between the inner layer body 10*b* and the outer layer body 10*a*. In the illustrated example, although two outside air introduction holes 12 are provided opposed to each other across the central axis of the mouth 11, at least one outside air introduction hole 12 would be enough. Further, although the outside air introduction hole 12 may be provided in the barrel and the bottom instead of the mouth 11, in this case, a check valve may be provided so as not to allow the air to flow out from the inner space between the outer layer body 10*a* and the inner layer body 10*b* or so as not to allow the air to easily flow out therefrom.

The outer periphery of the outer layer body 10*a* that forms the mouth 11 is integrally provided with a retaining protrusion 11*a* configured to hold the discharge cap 20 to prevent it from being fallen off. Further, a large-diameter step for sealing 11*b* is integrally provided under the retaining protrusion 11*a*. Moreover, a neck ring 13 protruded radially outside is provided under the step for sealing 11*b*. The discharge cap 20 is plugged into the mouth 11 with the undersurface 13*a* of the neck ring 13 supported by a support tool.

It is to be noted that the container body 10 may also be configured to include a plurality of adhesive layers (adhesive bands) vertically extending between the outer layer body 10*a* and the inner layer body 10*b* to partially attach the inner layer body 10*b* to the outer layer body 10*a*. Further, the container body 10 may be configured such that a barrier layer that improves barrier property against oxygen and moisture, for example, is laminated and disposed thereon or such that the barrier property is enhanced by a variety of coatings.

The discharge cap 20 is formed of a synthetic resin material, for example, and is attached to the mouth 11 of the container body 10 such that it surrounds the inner plug 30. The discharge cap 20 is formed into a topped tubular shape including a top wall portion 21 located above the partition wall 31 of the inner plug 30 and a cylindrical tube wall portion 22 located radially outside of the mouth 11. The inner periphery of the tube wall portion 22 is provided with a retaining recess 22*a*, and when the retaining recess 22*a* is fitted into the retaining protrusion 11*a* provided on the outer periphery of the mouth 11, the discharge cap 20 is fixed to and held by the mouth 11 of the container body 10.

The top wall portion 21 is integrally provided with the discharge tube 21*a* protruding upward from the top wall portion 21. The discharge tube 21*a* is disposed such that it is displaced from the axial center of the substantially circular top wall portion 21, and the inside thereof is provided with a discharge port 23 for contents. Further, the top wall portion 21 is provided with an air intake hole 24 configured to take the outside air. It is to be noted that an air passage directing from the air intake hole 24 toward the outside air introduction hole 12 is provided between the mouth 11 and the tube wall portion 22. The air passage can be formed, for example, by providing a groove at least in either one of the outer periphery of the mouth 11 and the inner periphery of the tube wall portion 22 or by providing a protrusion at least on either one of them such that a clearance is formed therebetween. The lower end of the tube wall portion 22 is in abutment over the entire periphery of the step for sealing 11*b* in an airtight manner so as to seal the air passage.

Figure 1B:
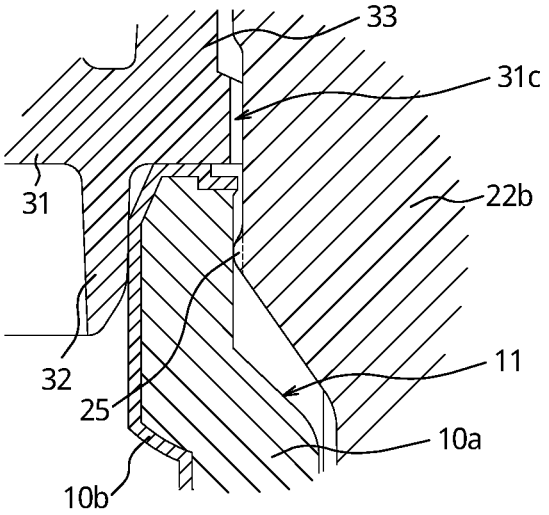
FIG. 1B is an enlarged partial view of FIG. 1A.

As illustrated in FIG. 1B, which is an enlarged partial view of FIG. 1A, the inner surface of the tube wall portion 22 is provided with a supporting protrusion 25, which serves as a deformation suppressing portion configured to support the upper end of the mouth 11 from outside in the radial direction. The supporting protrusion 25 is in abutment with the outer periphery of the outer layer body 10*a* on the upper end of the mouth 11. In the present disclosure, although a plurality of supporting protrusions 25 are circumferentially provided at intervals, it is not limited thereto, and the supporting protrusion 25 may be an annular protrusion that is in abutment with the outer periphery of the outer layer body 10*a* substantially all over the circumference. It is to be noted that, in this case, it is necessary to provide a groove or the like in the annular protrusion such that the air passage is not blocked completely, the air passage being formed between the mouth 11 and the tube wall portion 22 and directing from the air intake hole 24 toward the outside air introduction hole 12. Further, the supporting protrusion 25 is formed on the thick portion 22*b* of the tube wall portion 22. It is to be noted that the supporting protrusion 25 may not be provided, and the inner periphery (vertical surface) of the thick portion 22*b* may be used as the deformation suppressing portion. In other words, the inner periphery of the thick portion 22*b* may be in abutment with the outer periphery of the upper end of the mouth 11 so as to suppress a radially outward deformation.

The inner plug 30 is formed by a synthetic resin material, for example, and is attached to the inside of the discharge cap 20. The inner plug 30 has a partition wall 31 covering an opening of the mouth 11, a sealing tube 32 protruding from the undersurface of the partition wall 31 and being in abutment with the inner periphery (the inner periphery of the inner layer body 10*b*) of the mouth 11 and a supporting tube 33 extending upward from the outer peripheral edge of the partition wall 31. It is to be noted that, preferably, the outer diameter of the sealing tube 32 is set to be a slightly larger than the inner diameter of the mouth 11. Thus, the outer periphery of the sealing tube 32 is strongly in abutment with the inner periphery of the mouth 11 and the air tightness can be enhanced.

The upper end of the supporting tube 33 is in abutment with the undersurface of the top wall portion 21 and the outer periphery thereof is fitted into the inner surface of the tube wall portion 22. Thus the inner plug 30 is fixed to and held by the inside of the discharge cap 20.

The outflow hole 31*a* for contents passing through the partition wall 31 is provided in the central portion of the partition wall 31. The outflow hole 31*a* can communicate with the discharge port 23 provided in the discharge cap 20. The contents contained in the containing space S can flow through the outflow hole 31*a* toward the discharge port 23. On the upper surface of the partition wall 31 of the inner plug 30 is provided with an annular groove 31*b* that surrounds the outflow hole 31*a* on the radially inside of the supporting tube 33. A vent groove 31*c* vertically passing through the partition wall 31 is formed on the outer peripheral edge of the partition wall 31, and a communicating groove 33*a* communicating with the vent groove 31*c* is formed in the supporting tube 33.

The partition wall 31 is provided with a tubular wall 34 vertically passing therethrough, and a tapered portion 34*a* tapered downward is formed at the lower portion of the tubular wall 34. A moving valve body 35 that is movable in the axial direction of the tubular wall 34 is disposed on the inside of the tubular wall 34. In the illustrated example, although the moving valve body 35 has a spherical shape, it is not limited thereto, and those having a variety of shapes can be adopted.

The valve body 40 is disposed between the top wall portion 21 of the discharge cap 20 and the partition wall 31 of the inner plug 30, and is configured to open/close the outflow hole 31*a* provided in the partition wall 31. In other words, the valve body 40 allows the contents to move from the containing space S to the discharge port 23 and prevents the contents or the outside air from flowing from the discharge port 23 into the containing space S. The valve body 40 is formed of low density polyethylene (soft polyethylene), for example, and has a cylindrical base 41 and a disk shaped valve main body 43 integrally coupled to the inside of the base 41 through the elastic piece 42. The upper end portion of the base 41 is fitted into the annular groove 21*b* provided in the undersurface of the top wall portion 21, and the lower end portion thereof is fitted into the annular groove 31*b* provided on the top of the partition wall 31 of the inner plug 30. Thus the valve body 40 is fixed and held between the discharge cap 20 and the inner plug 30. It is to be noted that, in the present embodiment, although the valve body 40 is adapted to form a so-called three-point valve in which the valve main body 43 is supported by three elastic pieces 42, a check valve of other forms such as a so-called one-point valve in which the valve main body 43 is supported by a hinge can be used. A flow passage for contents directing from the outflow hole 31*a* provided in the partition wall 31 toward the discharge port 23 provided in the top wall portion 21 is formed on the inside of the base 41. Further, an air flow passage directing from the air intake hole 24 toward the communicating groove 33*a* and toward the vent groove 31*c* is formed on the outside of the base 41.

The lid body 50 is formed into a topped tubular shape whose diameter is almost the same as that of the discharge cap 20, and is pivotally coupled by a hinge 51 to the tube wall portion 22 of the discharge cap 20 so as to cover the discharge tube 21*a*. The inner surface of the lid body 50 is integrally provided with a cylindrical seal wall 52. When the lid body 50 is closed, the seal wall 52 is fitted into the discharge tube 21*a* and blocks the discharge port 23. The side opposed to the hinge 51 of the lid body 50 is provided with a knob 53 on which a finger is hooked to open the lid body 50.

It is to be noted that the lid body 50 is configured such that it is integrally coupled to the discharge cap 20 by the hinge 51, but it is not limited thereto, and the lid body 50 may be formed separately from the discharge cap 20 and attached to the discharge cap 20 by means of screwing or undercut engagement.

When the contents are discharged from the discharge container 1, the barrel is squeezed with the lid body 50 opened and the container body 10 tilted such that the discharge tube 21*a* faces downward. Thus the inner layer body 10*b* is pressed and the contents can be pushed out toward the outflow hole 31*a*. As a result of this, the valve main body 43 is opened and the contents in the containing space S is flown from the outflow hole 31*a* to the discharge port 23, and thus the contents can be discharged from the discharge port 23 toward the outside.

On the other hand, when the squeezing of the barrel is cancelled after the contents are discharged, the outflow hole 31*a* is blocked by the valve main body 43 and the air (outside air) is introduced from the air intake hole 24 due to a negative pressure generated when the outer layer body 10*a* restores to the original shape. The air introduced from the air intake hole 24 flows into the space between the inner layer body 10*b* and the outer layer body 10*a* through an air passage formed by the communicating groove 33*a*, the vent groove 31*c*, and a clearance formed between the mouth 11 and the tube wall portion 22. In this manner, when the outside air is introduced between the inner layer body 10*b* and the outer layer body 10*a*, the outer layer body 10*a* can be restored to the original shape with the inner layer body 10*b* deformed to undergo volume reduction. Thus, introduction of the outside air into the containing space S is suppressed such that contact of the contents contained in the container body 10 with the air is reduced, and as a result of this, change in the quality and deterioration of the contents can be suppressed. Further, when the discharge container 1 is tilted to discharge the contents, the moving valve body 35 moves to the side of the valve main body 43, and when the discharge container 1 is restored to the erecting posture from the tilting posture after the contents are discharged, the moving valve body 35 moves to the side of the tapered portion 34*a*. Thus, the contents in the discharge tube 21*a* can be sucked to the side of the tubular wall 34 through the clearance between the elastic piece 42 and the valve main body 43, and thus the contents can be prevented from dripping out of the discharge tube 21*a* by a so-called suck-back function.

In the discharge container 1 configured in the above described manner, the supporting protrusion 25 (deformation suppressing portion) configured to support the mouth 11 from radially outside is provided. Thus the upper end of the mouth 11 is sandwiched between the sealing tube 32 and the supporting protrusion 25 from radially inside and outside. As a result of this, the mouth 11 is prevented from being deformed radially inside or outside, and thus decline in air tightness between the mouth 11 and the sealing tube 32 can be suppressed even in the case where the contents are heated when filled.

Further, the thick portion 22*b* of the tube wall portion 22 has a high rigidity and is hard to be deformed. Thus a deformation suppressing effect can be enhanced by providing the supporting protrusion 25 on the thick portion 22*b*.

Further, in the present embodiment, the diameter of the upper end of the mouth 11 is smaller than that of the lower part of the mouth 11, which makes it easy to insert the mouth 11 into the discharge cap 20 when the discharge cap 20 is attached to the container body 10.

Another embodiment of the present disclosure will be described below. It is to be noted that the same reference signs are assigned to the parts having the same basic function as those described in the above described embodiment, and an explanation thereof is omitted.

Figure 2A:
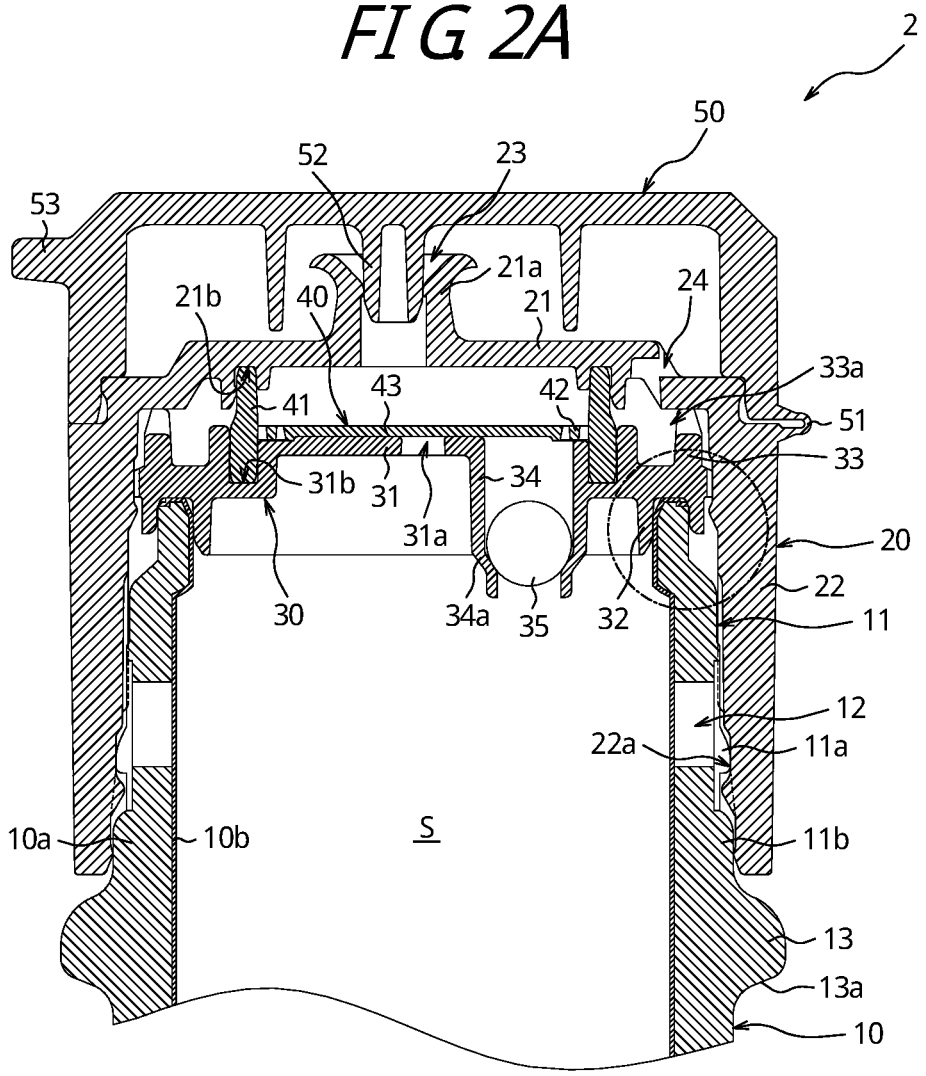
FIG. 2A is a cross-sectional diagram of a main part of a discharge container according to another embodiment of the present disclosure viewed from the side.
Figure 2B:
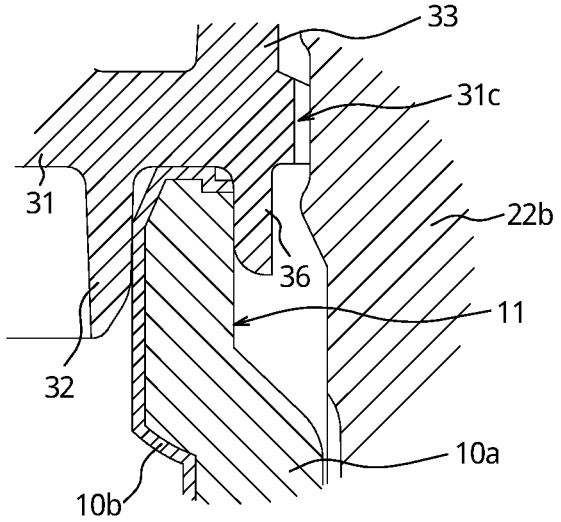
FIG. 2B is an enlarged partial view of FIG. 2A.

In a discharge container 2 illustrated in FIG. 2A, as a deformation suppressing portion, an outer peripheral tube 36 protruded from the undersurface of a partition wall 31 of an inner plug 30 is provided. On the upper end of a mouth 11, an outer peripheral tube 36 is in abutment with the outer periphery of an outer layer body 10*a* forming the mouth 11. In this manner, the mouth 11 is sandwiched between a sealing tube 32 and the outer peripheral tube 36 from radially inside and outside, and thus the mouth 11 is prevented from being deformed radially inside or outside. As a result of this, even when the contents are heated when filled, decline in the air tightness between the mouth 11 and the sealing tube 32 can be suppressed.

It is to be noted that, in the present embodiment, although the whole inner periphery of the cylindrical outer peripheral tube 36 is in abutment with the outer periphery of the outer layer body 10*a*, it is not limited thereto, and the inner periphery thereof may be in abutment with the outer periphery at a plurality of portions at intervals in the circumferential direction. It is to be noted that, in terms of enhancement of deformation suppressing effect, as with the present embodiment, preferably, the whole inner periphery of the outer peripheral tube 36 is in abutment with the outer periphery of the outer layer body 10*a*.

Figure 3:
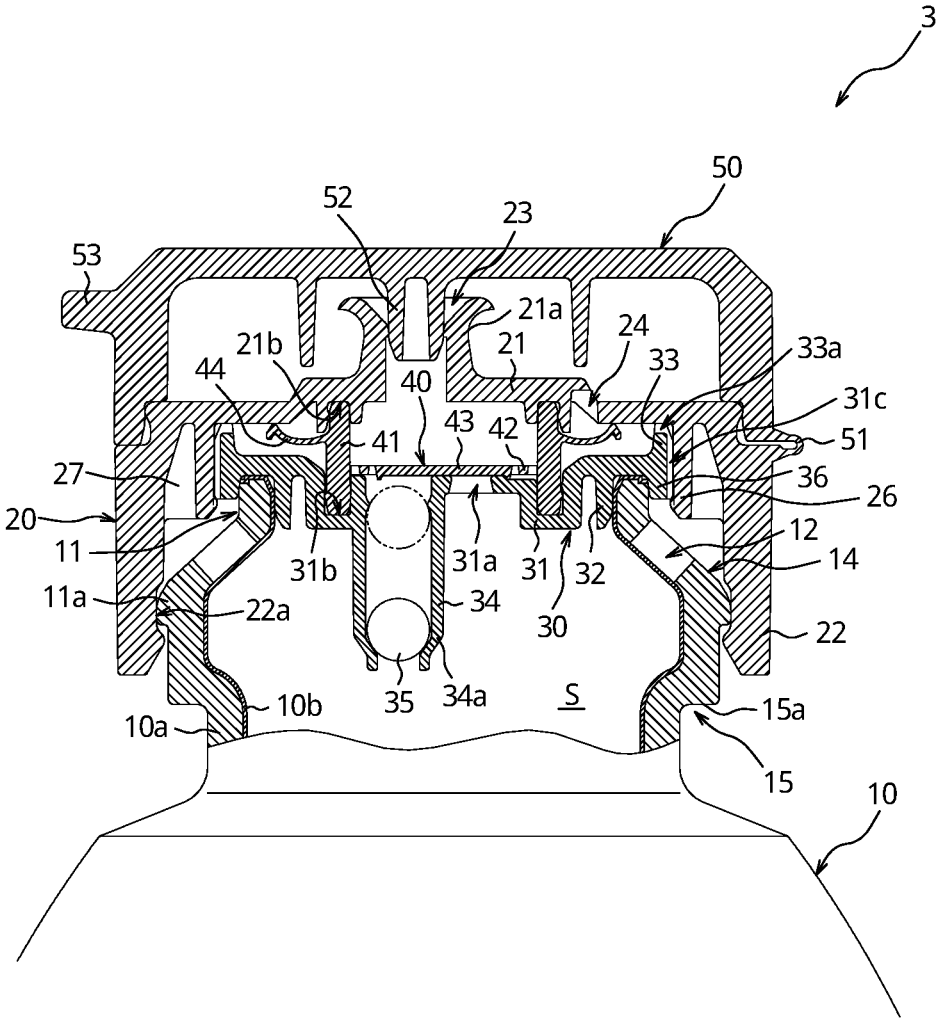
FIG. 3 is a cross-sectional view of a main part of a discharge container according to a still another embodiment of the present disclosure viewed from the side.
Figure 4:
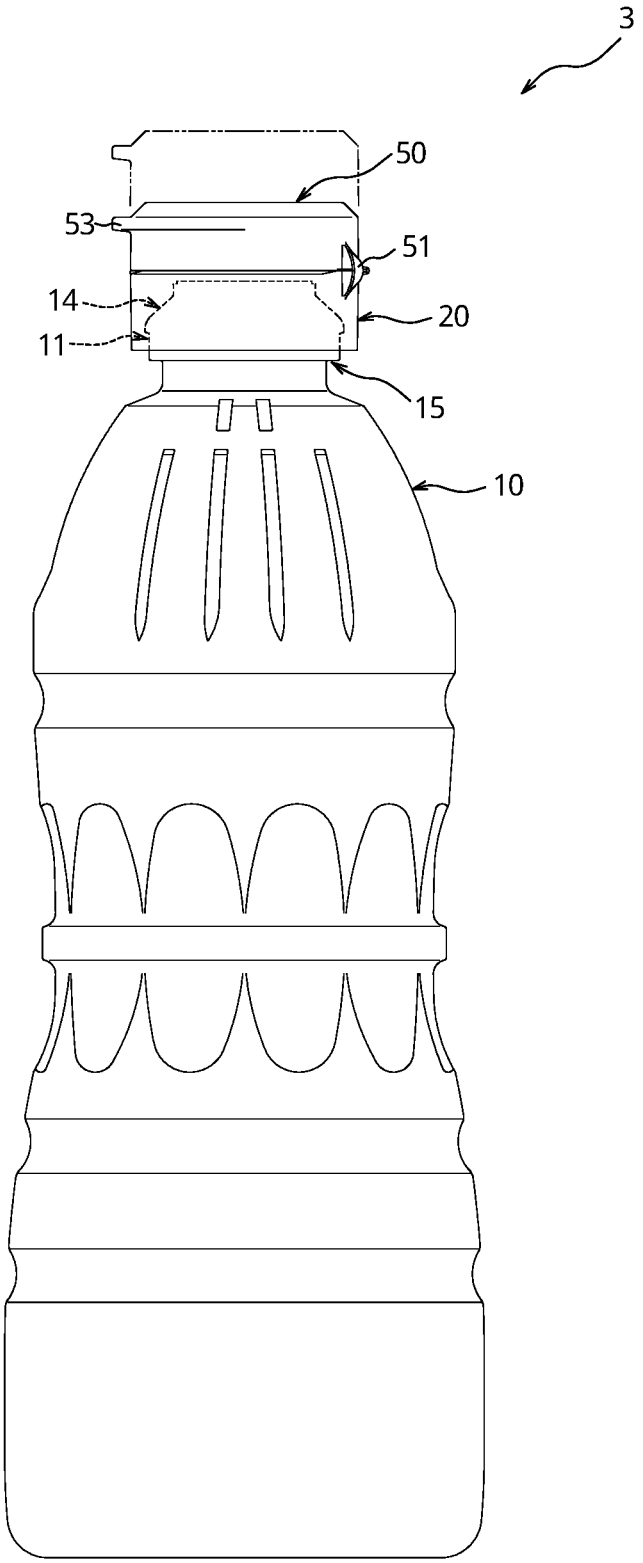
FIG. 4 is a side view of a whole discharge container illustrated in FIG. 3.

FIG. 3 illustrates a discharge container 3 according to still another embodiment. In the discharge container 3, a mouth 11 is provided with a tilt 14 tapered upward, and an outside air introduction hole 12 is formed in the tilt 14. Here, FIG. 4 illustrates an overall discharge container 3 of FIG. 3. When the tilt 14 is not provided in the mouth 11 (when the mouth is formed into a usual cylindrical shape), as illustrated by a two-dot chain line in FIG. 4, the vertical height of a discharge cap 20 covering the mouth 11 is high. On the contrary, the tilt 14 is provided in the present embodiment, and thus as illustrated by a solid body line in FIG. 4, the height of the mouth 11 and of the discharge cap 20 can be reduced, and thus the discharge container 3 can be miniaturized.

Further, in the discharge container 3, the neck ring 13 illustrated in FIG. 1 is not provided, and a recessed step 15 is provided under a mouth 11. As with the case where the neck ring 13 is provided, the mouth 11 is plugged with a discharge cap 20 by supporting the undersurface 15*a* of the step 15 with a supporting tool. In this manner, the step 15 is provided instead of the neck ring 13, and thus the height of overall container is reduced and the discharge container 3 can be miniaturized.

In the discharge container 3, as a deformation suppressing portion, an outer peripheral tube 36 protruding from the undersurface of a partition wall 31 of an inner plug 30 is provided, and the outer peripheral tube 36 supports the upper end of the mouth 11 from radially outside.

Here, the discharge cap 20 of the present embodiment is provided with a holding tube 26 protruding from the undersurface of the top wall portion 21 and configured to be fitted into and the inner plug 30 to hold it. The holding tube 26 is coupled to the tube wall portion 22 with a coupling rib 27 extending in the radial direction. The outer peripheral tube 36 as a deformation suppressing portion is supported by the tube wall portion 22 from radially outside through the holding tube 26 and the coupling rib 27, and thus the deformation suppressing effect can be further enhanced.

It is to be noted that, in the discharge container 3, the air intake hole 24 is opened or closed by an annular (flange-like) check valve 44 integrally coupled to the outside of the base 41. When configured in the above described manner, a pressure is easily transmitted to the inner layer body 10*b* when the outer layer body 10*a* is squeezed, which allows the contents to be easily discharged.

Figure 5A:
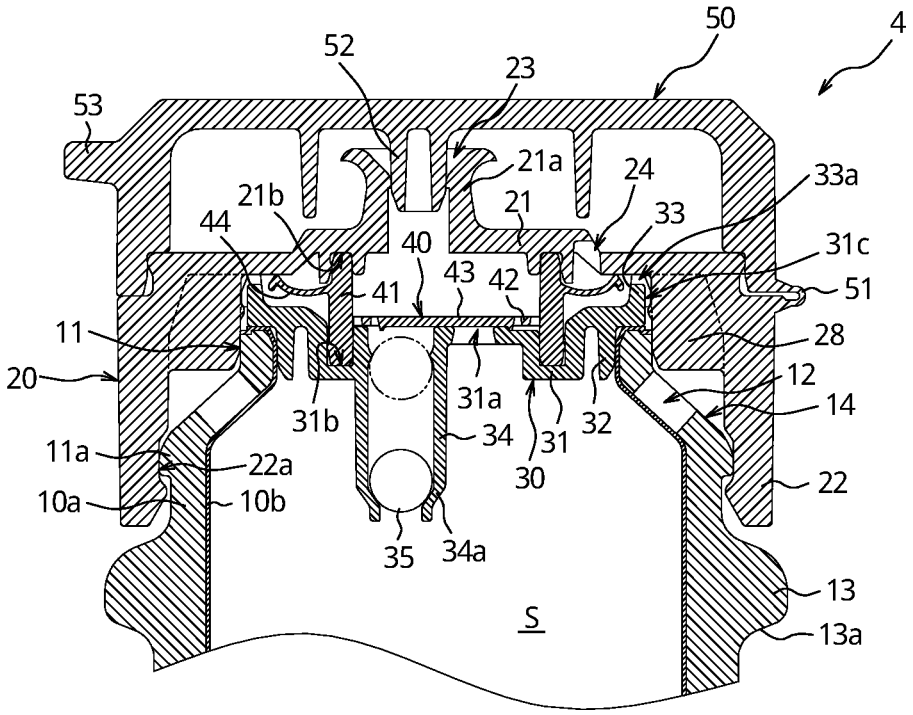
FIG. 5A is a cross-sectional view of a main part of a discharge container according to a yet another embodiment of the present disclosure viewed from the side.

FIG. 5A illustrates a discharge container 4 according to yet another embodiment. In the discharge container 4, as a deformation suppressing portion, a plurality of longitudinal ribs 28 are circumferentially provided at intervals on the discharge cap 20. Each longitudinal rib 28 is coupled to the top wall portion 21 and the tube wall portion 22, and the radial inner edge thereof is in abutment with the outer periphery of the upper end of the mouth 11 and supports it from radially outside.

Figure 5B:
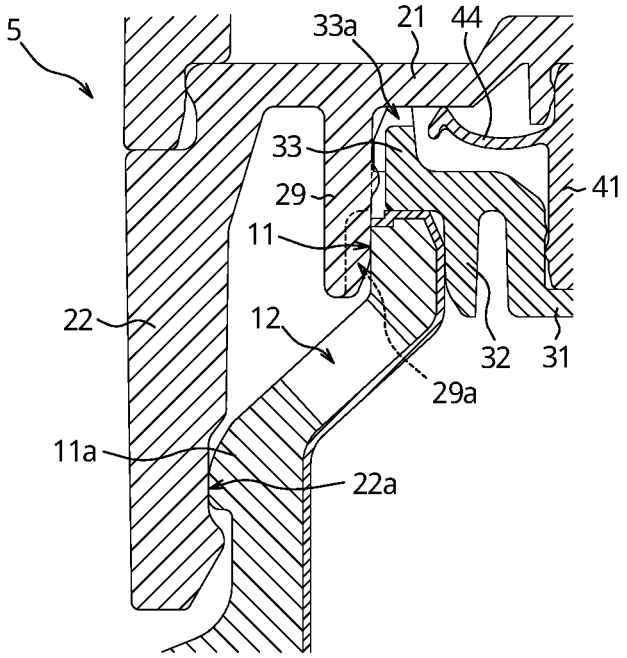
FIG. 5B is an enlarged cross-sectional view of the main part of the discharge container according to the yet another embodiment of the present disclosure viewed from the side.

FIG. 5B illustrates a discharge container 5 according to still yet another embodiment. In the discharge container 5, as a deformation suppressing portion, an annular supporting wall 29 protruded from the undersurface of a top wall portion 21 of a discharge cap 20 is provided. The inner periphery of the supporting wall 29 is in abutment with the outer periphery of the upper end of the mouth 11 and supports the upper end of the mouth 11 from radially outside. It is to be noted that the inner periphery of the supporting wall 29 is provided with a groove 29*a* that forms an air passage.

The present disclosure is not limited to the above described embodiments, and various changes may be made without departing from the gist thereof. For example, the discharge cap 20 may be attached to the mouth 11 not only by undercut engagement, but also by screw connection or the like.

REFERENCE SIGNS LIST

1 Discharge container
2 Discharge container
3 Discharge container
4 Discharge container
5 Discharge container
10 Container body
10*a* Outer layer body
10*b* Inner layer body
11 Mouth
11*a* Retaining protrusion
11*b* Step for sealing
12 Outside air introduction hole
13 Neck ring
14 Tilt
15 Step
15*a* Undersurface
20 Discharge cap
21 Top wall portion
21*a* Discharge tube
21*b* Annular groove
22 Tube wall
22*a* Retaining recess
22*b* Thick portion
23 Discharge port
24 Air intake hole
25 Supporting protrusion (deformation suppressing portion)
26 Holding tube
27 Coupling rib
28 Longitudinal rib (deformation suppressing portion)
29 Supporting wall (deformation suppressing portion)
29*a* Groove
30 Inner plug
31 Partition wall
31*a* Outflow hole
31*b* Annular groove
31*c* Vent groove
32 Sealing tube
33 Supporting tube
33*a* Communicating groove
34 Tubular wall
34*a* Tapered portion
35 Moving valve body
36 Outer peripheral tube (deformation suppressing portion)
40 Valve body
41 Base
42 Elastic piece
43 Valve main body
44 Check valve
50 Lid body
51 Hinge
52 Seal wall
53 Knob
S Containing space

The invention claimed is:

1. A discharge container comprising:

a container body including an outer layer body having an outside air introduction hole and an inner layer body held on an inside of the outer layer body, the inner layer body being configured to be deformable and to undergo volume reduction;

an inner plug including a partition wall covering an opening in a mouth of the container body and a sealing tube protruding from an undersurface of the partition wall, the sealing tube abutting against an inner periphery of the mouth;

a discharge cap including a discharge port from which contents within the discharge container are discharged and attached to the mouth so as to surround the inner plug from an outside; and a valve body disposed between the inner plug and the discharge cap, the valve body being configured to open and close an outflow hole provided in the partition wall, wherein the inner plug or the discharge cap has a deformation suppressing portion abutting against an outer periphery of an upper end of the mouth, the deformation suppressing portion being configured to prevent a radially outward deformation of the upper end of the mouth relative to the inner plug or the discharge cap that includes the deformation suppressing portion.

2. The discharge container according to claim 1, wherein the deformation suppressing portion is formed of a supporting protrusion provided at a tube wall portion of the discharge cap located radially outside of the mouth.

3. The discharge container according to claim 1, wherein the deformation suppressing portion is formed of an outer peripheral tube protruding from the undersurface of the partition wall.

4. The discharge container according to claim 1, wherein the deformation suppressing portion is formed of a plurality of longitudinal ribs provided on the discharge cap and disposed circumferentially at intervals in the circumferential direction of the discharge cap.

5. The discharge container according to claim 1, wherein the deformation suppressing portion is formed of an annular supporting wall protruding from an undersurface of a top wall portion of the discharge cap.

* * * * *